US005972576A

United States Patent [19]

Poncelet et al.

[11] Patent Number: 5,972,576

[45] Date of Patent: Oct. 26, 1999

[54] METHOD OF DECONTAMINATING A PHOTOGRAPHIC BATH WITH HEAT-REVERSIBLE POLYMERS

[75] Inventors: Olivier J. Poncelet, Chalon sur Saone; Danielle M. Wettling, Chatenoy le Royal; Jeannine Rigola, Chalon sur Saone, all of France

[73] Assignee: Eastman Kodak Company, Rochester, N.Y.

[21] Appl. No.: 09/196,455

[22] Filed: Nov. 19, 1998

[30] Foreign Application Priority Data

Nov. 19, 1997 [FR] France ..... 97 14742

[51] Int. Cl.[6] ..... G03C 5/395

[52] U.S. Cl. ..... 430/398; 430/399; 430/400

[58] Field of Search ..... 430/398, 399, 430/400

[56] References Cited

U.S. PATENT DOCUMENTS

| | | | |
|---|---|---|---|
| 3,497,467 | 2/1970 | Coleman | 524/398 |
| 3,691,086 | 9/1972 | Lees et al. | 516/142 |
| 4,144,373 | 3/1979 | Weiss et al. | 252/62.54 |
| 5,015,560 | 5/1991 | Koboshi et al. | 430/400 |
| 5,059,514 | 10/1991 | Ueda et al. | 430/398 |
| 5,219,717 | 6/1993 | Schmittou et al. | 430/398 |
| 5,432,245 | 7/1995 | Roberts et al. | 427/385.5 |
| 5,858,630 | 1/1999 | Poncelet et al. | 430/398 |

FOREIGN PATENT DOCUMENTS 1450588 9/1976 United Kingdom .

*Primary Examiner*—Hoa Van Le
*Attorney, Agent, or Firm*—John R. Everett

[57] ABSTRACT

The invention concerns a method for decontaminating a used photographic processing bath.

This method consists of putting the processing bath in contact with a heat-reversible hydrophilic polymer which becomes hydrophobic above a temperature lower than the temperature of the processing bath.

The tars and other organic contaminants present in the used photographic processing bath can be removed by cooling the heat-reversible polymer below the temperature where it becomes hydrophilic.

9 Claims, No Drawings

METHOD OF DECONTAMINATING A PHOTOGRAPHIC BATH WITH HEAT-REVERSIBLE POLYMERS

FIELD OF THE INVENTION

The present invention concerns a method of treating photographic baths containing organic contaminants.

BACKGROUND OF THE INVENTION

Conventionally, silver halide photographic materials, after exposure, are developed in a plurality of photographic processing baths. The processing of black and white photographic materials generally comprises a black and white development step, a fixing step and a washing step. The processing of colour photographic materials comprises a colour development step, a bleaching step, a fixing step and a washing step.

During the processing of these photographic materials, the composition of the processing bath changes. In particular, the photographic baths become loaded with chemical substances such as gelatin, latex, polymers, surfactant, and numerous other organic substances either initially incorporated into the photographic materials or released upon the reactions at the time of development. These substances contaminates the baths and reduces their efficacy. In addition, the presence of these contaminants in the photographic processing baths results not only in a variation in the sensitometry of the photographic materials but also a fouling of the processing machine and therefore of the materials which are processed therein. This phenomenon is all the more significant since photographic materials are generally processed in automatic processing machines. The machines which make it possible to develop photographic materials quickly are also fouled more quickly. In particular, there appear, in the photographic processing baths of these automatic machines, tars which originate from organic constituents of the photographic materials and which are deposited on the photographic material in the course of the processing and foul the machine. The presence of these tars requires a significant amount of maintenance of the processing machines, an earlier replacement of the baths and, in extreme cases, several successive steps of washing the photographic materials.

It is known from the art that this drawback can be remedied by adding surfactants to the baths during the processing with a view to dissolving the tars present. However, large amounts of these agents must be used and this modifies the stability and efficacy of the processing bath.

The accumulation, in the washing and/or stabilising baths, of substances resulting from the previous steps of the processing is not only prejudicial to the stability of the photographic images developed, to the obtention of unvarying sensitometric characteristics and to the maintenance of the equipment, but also interferes with the possibility of recycling these washing and stabilising baths or of discharging them to the drains. At the end of processing, compounds which contribute to raise the COD of the solution are found in the washing and stabilising baths.

The effluent can for example be subjected to electrolytic oxidation, dialysis, reverse osmosis (as described in the German patent application 3 246 897), flocculation, or oxidation with hydrogen peroxide, optionally coupled with UV treatment, as described in U.S. Pat. No. 5,439,599 of Géhin et al. It is also possible to combine non-catalytic oxidation with catalytic oxidation and biological treatment, as described in European patent application 690 025.

The treatments described in the literature usually recommend combining two or more techniques in order to obtain satisfactory decontamination of the effluent, enabling it to be discharged, or to eliminate the substances which would be prejudicial to re-use of the effluent. Some of these techniques also have a high cost of application. This is because it is desirable to develop a method which makes it possible to eliminate these substances and tars economically and rapidly, without impairing the sensitometric properties of the photographic materials processed and without modifying the stability or efficacy of the photographic processing baths.

The object of the present invention is to solve the afore mentioned problems associated with the presence of the organic substances and tars in the photographic processing baths.

Another object of the invention is to reduce the fouling of automatic processing machines and thus to make maintenance operations on these machines less frequent.

SUMMARY OF THE INVENTION

These objects and others are achieved by the method of the present invention, which comprises the step of (1) bringing a photographic bath containing organic contaminants and tars in contact with a heat-reversible polymer which is photographically inert and resistant to a high pH, and is hydrophobic at a temperature above the LCST of the polymer, whereby the heat-reversible polymer absorbs the organic substances contained in the processing bath, and (2) separating the polymer from the processing bath.

DETAILED DESCRIPTION OF THE INVENTION

In the present description and in the claims which accompany it:

- the terms "photographic effluent" or "standard photographic effluent" designate a used (or "seasoned ") photographic processing solution containing hydrophobic organic substances, in particular tars, and surfactants;
- the COD of these effluents is between 5 and 30 g/l, preferably between 10 and 20, measured according to the AFNOR standard NF T90-101.

Heat-reversible polymers are polymers whose structure and properties vary according to temperature, which means that, at a given temperature (designated as LCST-lower critical solution temperature), they undergo a transition which modifies their affinity for either hydrophilic or hydrophobic substances. These polymers, their preparation, their structure and their applications as systems for releasing active principles, have been described in the literature, for instance by T. Tanaka, in Sc. Am., 1981, 244(1) 125, or by R Yoshida et al, in Adv. Drug. Delivery Rev. 1993, II, 85.

The use of these polymers has been recommended for purifying effluents, as described for example in European patent application 648 521. However, one of the known characteristics of heat-reversible hydrogels is that their transition temperature can vary significantly as a function of various parameters, especially the presence of surfactants in the effluent, as mentioned by Y. Q. Zhang et al in Langmuir 1995, 11, 2493–5. This variability of the transition constitutes a priori an obstacle to a routine utilisation of hydrogels for decontaminating photographic effluents, which practically always contain surfactants or substances possessing surfactant properties to various degrees.

The method of the present invention makes it possible to decontaminate a photographic effluent and in particular to eliminate the tars therefrom, by virtue of the use of heat-reversible polymers. It has in fact been discovered that, surprisingly, the heat-reversible polymer keeps a practically constant transition temperature in the presence of a standard photographic effluent, in spite of the presence of surfactants.

The heat-reversible polymers used according to the invention advantageously contain units derived from a monomer of formula:

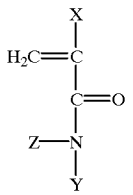

wherein X is H or $CH_3$;

Z and Y represent H, or an alkyl group containing from 1 to 6 carbon atoms, linear or branched, a cycloalkyl group of 3 to 7 carbon atoms or an aryl group of from 6 to 10 carbon atoms, provided that and Y cannot both represent H, and Z and Y can be combined to form a nitrogenous heterocyclic compound.

According to one embodiment, the heat-reversible polymer is a polymer or copolymer of N-alkylmethacrylamide, N-alkylacrylamide where alkyl represents a linear or branched alkyl group containing from 1 to 6 carbon atoms, such as methyl, ethyl, n-propyl, isopropyl, n-butyl, etc.

The polymers of the polyacrylamide type used according to the invention must have a low LCST (lower critical solution temperature). Above this temperature, they are hydrophobic and contract in water. Below this temperature, they hydrate and become hydrophilic. Low LCST according to the present means an LCST of preferably from about 20 to about 70° C. which, in addition, is not affected by the presence of high concentrations of mineral salts or surfactants in the effluent, as is the case with photographic effluents. This LCST range of 20–70° C. corresponds to a quite identical working temperature range for step (1) of the method of the invention since the shift of the polymer from the hydrophilic to the hydrophobic state takes place generally once the temperature exceeds the LCST by one ° C. or even less than one ° C. In addition, the polymers are stable at a pH greater than 10, which is usually encountered in photographic effluents. Their use with photographic effluents is therefore greatly simplified.

One consequence of the above is also that the properties of the polymer depend on the temperature at which the polymerisation is effected. If polymerisation is effected at a temperature above the LCST, an opaque hydrophobic polymer is obtained. If polymerisation is effected at a temperature below the LCST, a transparent hydrophilic gel is obtained. This transparent gel, as soon as it is heated above the LCST (around 35° C.), contracts and becomes opaque and hydrophobic, quite instantaneously.

A poly(N-isopropylacrylamide) useful according to the invention can for example be obtained by the following procedure.

A solution of monomer in water is prepared. To this solution a cross-linking agent of the N,N'-methylene-bisacrylamide or dihydroxyethylene-bisacrylamide type, a polymerisation initiator of the persulphate type, sodium and potassium 2,2-azobisisobutronitrile and an accelerator of the tetramethylethylenediamine type, or ammonium peroxodisulphate, or sodium metabisulphite, are added.

A free-radical polymerisation reaction takes place and, after a few minutes, the polymer is obtained. Operating methods of this type were described in J. of Polym. Sc., Vol. 30 (1992) by Wu et al.

According to one embodiment, it is possible to produce a porous gel by adding a pore-forming material at the moment of polymerisation, or before it. Pore-forming materials are for example hydroxycellulose, cellulose and chitin. They must not inhibit the free-radical polymerisation.

Given that porous polymers have a higher swelling rate below the LCST, and a higher contraction rate above the LCST, their capacity to absorb substances and to expel them is therefore increased.

The polymer can be used in the form of a membrane, optionally on an appropriate support, or introduced into a container which is permeable to the effluent. The polymer can be obtained in the form of a sponge, by adding a pore-forming material at the time of synthesis. In this form, the contact surface area and therefore the efficiency in trapping organic substances are increased. In addition, in this form, the polymer withstands mechanical stresses better and can therefore bear more absorption/regeneration cycles. Such a sponge can be disposed in a cartridge which can easily be handled. If the effluent is circulated in the cartridge at a temperature higher than the LCST of the polymer, the latter is hydrophobic and traps the organic substances. When the sponge is saturated, it can be cooled to room temperature, preferably by immersing it in a cold mineral oil or an equivalent hydrophobic liquid (for example a liquid paraffinic substance) so that the trapped substances are released from the polymer. After washing with water, the sponge is then ready for a new utilisation cycle. Saturation of the sponge can be predetermined in instructions for use, according to the characteristics of the polymer and of the effluent for which it is intended.

Another embodiment consists of shaping the polymer by using polystyrene foam, according to a technique similar to lost-wax casting performed in metal processing. This technique is implemented as follows: a receptacle is filled with polystyrene beads, previously degassed with argon, and then the ingredients for preparing the hydrogel are introduced into the receptacle, as indicated above; polymerisation is carried out, and then the polystyrene is eliminated with a suitable solvent. It will be understood that it is possible to use other polymers in place of polystyrene.

EXAMPLE

A porous polyisopropylacrylamide gel was prepared according to the operating method of the publication by Wu mentioned above. The cross-linking agent was N,N'-dihydroxyethylenebisacrylamide, the polymerisation initiator was ammonium persulphate and the accelerator was tetramethylethylenediamine. In 50 ml of degassed water, there were mixed 9 g of N-isopropylacrylamide purified by crystallisation in hexane, 0.398 g of N,N'-dihydroxyethylenebisacrylamide and 2 g of polystyrene balls (diameter of between 2 and 5 mm). The solution was degassed with argon; 0.1 ml of tetramethylethylenediamine and 0.1 ml of ammonium persulphate were added. The solution was raised to 4° C. and maintained at this temperature for 1 hour. After one hour, the polymer was formed and was in the form of an opaque gel. The polystyrene was then dissolved in ethyl ether. This gel had an LCST below 35° C.

A sample of this gel was raised to a temperature above the LCST (36° C.) for 12 hours. It contracted and became hydrophobic. 0.9 g of the hydrophobic hydrogel was weighed out. It was reprocessed in a hydrophilic form by soaking in osmosed water at a temperature below the LCST for 12 hours; the weight of hydrophilic hydrogel was then 1.5 g. This hydrogel was placed in 50 ml of an effluent resulting from the processing of Eastman Color Positive film at a pH of 10.8 and a temperature of 36.5° C. The hydrogel was therefore in its hydrophobic form. It was left in contact with the effluent for 12 hours. The hydrogel was then immersed in a mineral oil at room temperature (below the LCST). The UV spectrum of the mineral oil was produced and it was found that this spectrum contained the peaks of the conventional organic contaminants and tars present in the original effluent.

The invention has been described in detail with particular reference to certain preferred embodiments thereof, but it will be understood that variations and modifications can be effected within the spirit and scope of the invention.

We claim:

1. A method for decontaminating an aqueous photographic processing bath by removing from this processing bath hydrophobic substances which are found therein, which method comprises the steps of (1) putting the bath in contact with a heat-reversible polymer which is hydrophobic at a temperature above the low critical solution temperature (LCST) of the polymer, whereby the heat-reversible polymer absorbs hydrophobic substances contained in the processing bath, and (2) separating the polymer from the processing bath.

2. The method of claim 1, wherein after step (2), the heat-reversible polymer is cooled below the LCST whereby it becomes hydrophilic and desorbs the hydrophobic substances which it had absorbed at step (1).

3. The method of claim 2, wherein steps (1) and (2) are repeated at least once.

4. The method of claim 2, wherein after step (2), the polymer is cooled to room temperature.

5. The method of claim 1, wherein the polymer is a N-alkylacrylamide or N-alkyl-acrylmethacrylamide polymer or copolymer.

6. The method of claim 1, wherein the polymer is a cross-linked polymer.

7. The method of claim 5, wherein the polymer is a N-isopropylacrylamide polymer.

8. The method of claim 1, wherein the polymer is porous.

9. The method of claim 1, wherein the polymer is in the form of a sponge.

* * * * *